US010223995B2

(12) United States Patent
Han et al.

(10) Patent No.: US 10,223,995 B2
(45) Date of Patent: Mar. 5, 2019

(54) DISPLAY DEVICE HAVING A LIQUID CRYSTAL DISPLAY PANEL AND AN OLED BACKLIGHT

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Peng Han, Beijing (CN); Hao Zhang, Beijing (CN); Lingyun Shi, Beijing (CN); Xiurong Wang, Beijing (CN); Bo Gao, Beijing (CN); Yafei Li, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 7 days.

(21) Appl. No.: 15/222,161

(22) Filed: Jul. 28, 2016

(65) Prior Publication Data

US 2017/0193931 A1 Jul. 6, 2017

(30) Foreign Application Priority Data

Jan. 4, 2016 (CN) ..... 2016 1 0004880

(51) Int. Cl.
*G09G 3/36* (2006.01)
*G09G 3/3266* (2016.01)
*G09G 3/3275* (2016.01)

(52) U.S. Cl.
CPC ..... *G09G 3/3685* (2013.01); *G09G 3/3266* (2013.01); *G09G 3/3275* (2013.01); (Continued)

(58) Field of Classification Search
CPC .. G09G 3/3607; G09G 3/2003; G09G 3/3266; G09G 3/3426; G09G 3/2077; G09G 3/3406; G09G 3/3611
See application file for complete search history.

(56) References Cited

U.S. PATENT DOCUMENTS

2006/0187181 A1* 8/2006 Kim ..... G09G 3/3413 345/102
2007/0057881 A1 3/2007 Yu et al.
(Continued)

FOREIGN PATENT DOCUMENTS

CN 1808242 A 7/2006
CN 101295096 A 10/2008
(Continued)

OTHER PUBLICATIONS

The First Chinese Office Action dated Aug. 2, 2017; Appln. 201610004880.9.

*Primary Examiner* — Kevin M Nguyen
(74) *Attorney, Agent, or Firm* — Ladas & Parry LLP

(57) ABSTRACT

A display driving circuit for driving pixel cells located on a liquid crystal display panel and sub-pixels located on an OLED panel which is an OLED backlight, one of the pixel cells corresponding to at least one of the sub-pixels, the display driving circuit comprising: a shift register unit having a source signal terminal, a pulse signal terminal, and at least one signal output terminal, and configured to output a signal inputted from the source signal terminal to the signal output terminal under control of the pulse signal terminal; wherein the one of the pixel cells and the at least one of the sub-pixels corresponding thereto are connected to the same signal output terminal.

18 Claims, 4 Drawing Sheets

(52) U.S. Cl.
CPC ..... *G09G 3/3611* (2013.01); *G09G 3/3674* (2013.01); *G09G 2300/023* (2013.01); *G09G 2310/0286* (2013.01)

(56) References Cited

U.S. PATENT DOCUMENTS

| | | | | |
|---|---|---|---|---|
| 2009/0002280 | A1* | 1/2009 | Kim | G09G 3/3233 345/76 |
| 2009/0121985 | A1 | 5/2009 | Kang et al. | |
| 2009/0135108 | A1* | 5/2009 | Lindfors | G09G 3/3426 345/76 |
| 2009/0262065 | A1* | 10/2009 | Shin | G09G 3/3406 345/102 |
| 2011/0102450 | A1* | 5/2011 | Santo | G09G 3/3406 345/589 |
| 2015/0243212 | A1* | 8/2015 | Lee | G09G 3/3216 345/212 |
| 2017/0206843 | A1 | 7/2017 | Liu et al. | |

FOREIGN PATENT DOCUMENTS

| | | | |
|---|---|---|---|
| CN | 203037965 | U | 7/2013 |
| CN | 104898322 | A | 9/2015 |

* cited by examiner

DISPLAY DEVICE HAVING A LIQUID CRYSTAL DISPLAY PANEL AND AN OLED BACKLIGHT

TECHNICAL FIELD

The present disclosure relates to a display driving circuit, a method for controlling the display driving circuit, and a display device.

BACKGROUND

A Liquid Crystal Display (LCD) comprises a color film substrate, an array substrate, and a backlight module for providing a light source. In comparison with the LCD, an Organic Light Emitting Diode (OLED) display has a self-luminous advantage as a current-type light emitting device.

Usually, an OLED panel which is an OLED backlight may be disposed on a non-display side of a liquid crystal display panel to provide backlight for the LCD. In this case, the backlight module and the color film substrate may be removed from the LCD. Accordingly, structure of the LCD can be simplified.

To drive the OLED panel and the LCD panel to display, typically, driver ICs for driving the OLED panel and the liquid crystal display panel need to be set separately. However, as a result, the number of driver ICs will be increased, which leads to a complex product structure and a cost rising.

SUMMARY

Embodiments of the present disclosure provide a display driving circuit, a method for controlling the display driving circuit, and a display device, which are capable of solving the problems of a complex product structure and a cost rising due to a separate arrangement of driver ICs for driving the OLED panel and the liquid crystal display panel.

An aspect of the embodiments of the present disclosure provides a display driving circuit for driving pixel cells located on a liquid crystal display panel and sub-pixels located on an OLED panel which is an OLED backlight, one of the pixel cells corresponding to at least one of the sub-pixels, the display driving circuit comprising: a shift register unit connected respectively to a source signal terminal, a pulse signal terminal, and at least one signal output terminal, and configured to output a signal inputted from the source signal terminal to the signal output terminal under control of the pulse signal terminal; wherein one pixel cell and at least one sub-pixel corresponding to the one pixel cell are connected to the same signal output terminal.

Optionally, the at least one sub-pixel corresponding to one of the pixel cells includes a first sub-pixel, a second sub-pixel, and a third sub-pixel, the at least one signal output terminal includes a first signal output terminal, a second signal output terminal, and a third signal output terminal; the first signal output terminal is connected to the pixel cell and the first sub-pixel; the second signal output terminal is connected to the pixel cell and the second sub-pixel; the third signal output terminal is connected to the pixel cell and the third sub-pixel; and light rays that respectively transmit through the first sub-pixel, the second sub-pixel, and the third sub-pixel constitute light rays of three primary colors.

Optionally, the display driving circuit further comprises a gate driver and a source driver; the gate driver is connected to the pixel cell via a first gate line, and configured to control tuning-on of the pixel cell via the first gate line; the gate driver is connected to the sub-pixel via a second gate line, and configured to control tuning-on of the sub-pixel via the second control gate line; and the source driver is connected to the source signal terminal, and configured to output a data signal to the source signal terminal.

Optionally, the display driving circuit further comprises a pulse signal generator connected to the pulse signal terminal and configured to input a pulse signal to the pulse signal terminal.

Optionally, the first gate line and the second gate line are connected to each other.

Another aspect of the present disclosure provides a display device, comprising a liquid crystal display panel and an OLED panel which is an OLED backlight disposed opposite to each other, and further comprising any of the display driving circuit described above.

Yet another aspect of the embodiments of the present disclosure provides a method for controlling any of the display driving circuit described above, the method comprising: outputting, by the shift register unit, a signal from the source signal terminal to the signal output terminal under control of the pulse signal terminal; and charging, by the signal output terminal, one pixel cell and the at least one sub-pixel that are connected to the same signal output terminal.

Optionally, in a case where the at least one sub-pixel corresponding to one of the pixel cells includes a first sub-pixel, a second sub-pixel, and a third sub-pixel, the at least one signal output terminal includes a first signal output terminal, a second terminal, and a third signal output terminal, the method comprises: inputting a first pulse signal from the pulse signal terminal, outputting a signal from the source signal terminal to the first signal output terminal, and charging the pixel cell and the first sub-pixel via the first signal output terminal by the shift register unit; inputting a second pulse signal from the pulse signal terminal, outputting a signal from the source signal terminal to the second signal output terminal, and charging the pixel cell and the second sub-pixel via the second signal output terminal by the shift register unit; and inputting a third pulse signal from the pulse signal terminal, outputting a signal from the source signal terminal to the third signal output terminal, and charging the pixel cell and the third sub-pixel via the third signal output terminal by the shift register unit.

Optionally, prior to outputting, by the shift register unit, a signal from the source signal terminal to the signal output terminal under control of the pulse signal terminal, the method comprises: controlling, by the gate driver, tuning-on of the pixel cell via the first gate line; controlling, by the gate driver, tuning-on of the sub-pixel corresponding to the pixel cell via the second gate line; and outputting, by the source driver, a data signal to the source signal terminal.

Optionally, prior to outputting, by the shift register unit, a signal from the source signal terminal to the signal output terminal under control of the pulse signal terminal, the method comprises: inputting, by a pulse signal generator, a pulse signal to the pulse signal terminal.

The embodiments of the present disclosure provide a display driving circuit, a method for controlling the display driving circuit, and a display device, the display driving circuit is for driving pixel cells located on a liquid crystal display panel and sub-pixels located on an OLED panel which is an OLED backlight, one the pixel cell corresponds to at least one sub-pixel. Further, the display driving circuit comprises a shift register unit. The shift register unit is connected respectively to a source signal terminal, a pulse signal terminal, and at least one signal output terminal, and configured to output a signal inputted from the source signal terminal to the signal output terminal under control of the pulse signal terminal. One pixel cell and at least one sub-pixel corresponding to the one pixel cell are connected to the same signal output terminal.

Since one pixel cell and at least one sub-pixel corresponding to the one pixel cell are connected to the same signal output terminal, when the shift register unit outputs a data signal inputted from the source signal terminal to the signal output terminal under the control of the pulse signal terminal, the pixel cell and the sub-pixel that are connected to the signal output terminal can simultaneously receive the data signal to complete pixel charging and perform displaying. In this way, by means of the display driving circuit, pixel cells located on the liquid crystal display panel and sub-pixels located on the OLED panel which is an OLED backlight can be simultaneously driven to display, without disposing driving circuits separately for the liquid crystal display panel and the OLED panel, which can simplify product structure and reduce costs.

DETAILED DESCRIPTION OF THE EMBODIMENTS

Hereinafter, the embodiments of the present disclosure will be described clearly and comprehensively in combination with the drawings. Obviously, these described embodiments are merely parts of the embodiments of the present disclosure, rather than all of the embodiments thereof.

Figure 1:
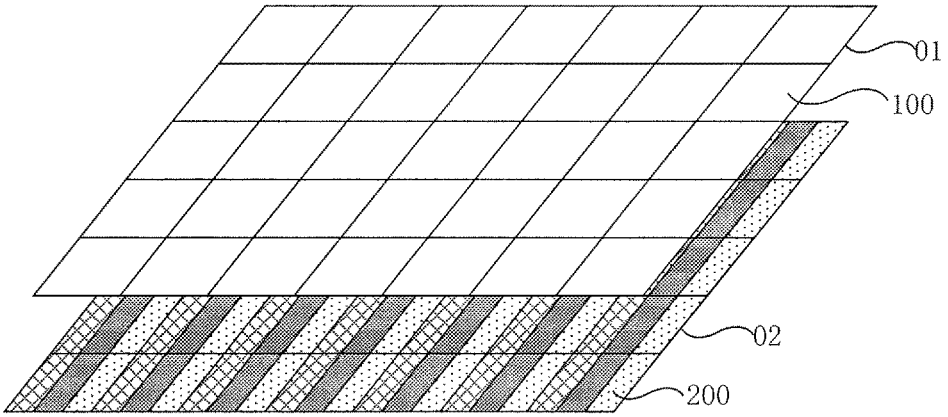
FIG. 1 is a schematic diagram of structure of a display device composed of a liquid crystal display panel and an OLED panel which is an OLED backlight provided by an embodiment of present disclosure.

FIG. 1 shows a schematic diagram of structure of a display device composed of a liquid crystal display panel and an OLED panel which is an OLED backlight provided by an embodiment of present disclosure. As shown in FIG. 1, pixel cells 100 are located on the liquid crystal display panel 01, and sub-pixels 200 are located on the OLED panel 02. In FIG. 1, one pixel cell 100 corresponds to at least one sub-pixel 200. On basis of this, one pixel cell 100 corresponding to at least one sub-pixel 200 as mentioned above refers to that upper and lower positions of the pixel cell 100 and the sub-pixel 200 correspond to each other, and the sub-pixel 200 is completely covered by the pixel cell 100, so that most of backlight emitted by the sub-pixel 200 can enter the pixel cell 100 corresponding to the sub-pixel 200.

It should be noted that, herein, directional terms such as "upper", "lower", "left", and "right" and so on are defined with respect to a schematic placed orientation of the liquid crystal display panel 01 and the OLED panel 02 which is an OLED backlight in the drawings. As will be appreciated, these directional terms are relative concepts, and used to describe and clarify relative positional relationship that may change accordingly based on a change of orientation in which the liquid crystal display panel 01 and the OLED panel 02 are placed.

Figure 2:
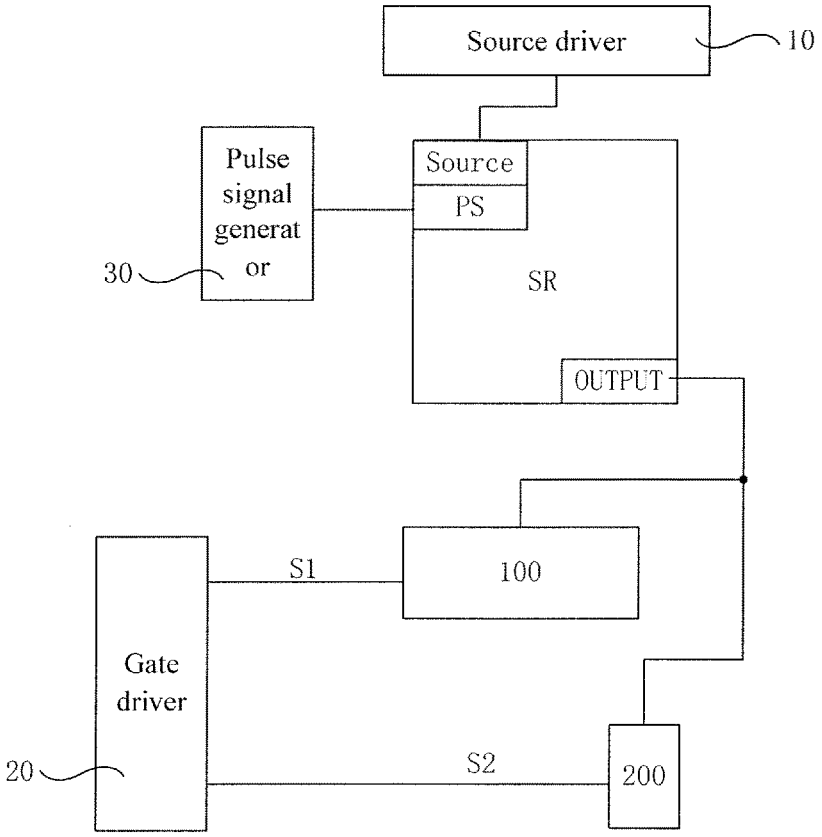
FIG. 2 is a schematic diagram of structure of a display driving circuit provided by an embodiment of the present disclosure.

FIG. 2 shows a schematic diagram of structure of a display driving circuit provided by an embodiment of the present disclosure. As shown in FIG. 2, the display driving circuit comprises a shift register unit SR, the shift register unit SR has a source signal terminal Source, a pulse signal terminal PS, and at least one signal output terminal OUTPUT. For example, the shift register unit SR is configured to output a signal from the source signal terminal Source to the signal output terminal OUTPUT under control of the pulse signal terminal PS.

In FIG. 2, one pixel cell 100 and at least one sub-pixel 200 corresponding to the one pixel cell 100 are connected to the same signal output terminal OUTPUT.

It should be noted that, the source signal terminal Source can provide a required data signal Vdata to the liquid crystal display panel 01 and the OLED panel 02 which is an OLED backlight. For example, as shown in FIG. 2, the display driving circuit may comprise a source driver 10, the source driver 10 may be connected to the source signal terminal Source of the shift register unit SR and used to input the data signal Vdata into the source signal terminal Source.

At this time, the data signal Vdata can enable pixel electrodes in the pixel cell 100 on the liquid crystal display panel 01 to be charged, thereby changing electric field between the pixel electrodes and a common electrode of the liquid crystal display panel 01. Accordingly, the aim of changing a deflection angle of liquid crystal molecules in the pixel cell 100 is achieved, so that light outgoing amount of the pixel cell 100 can be adjusted to display different grayscales.

Further, the data signal provided by the source signal terminal Source to the OLED panel 02 which is an OLED backlight can be used to control a light emitting luminance of OLED in sub-pixels on the OLED panel 02, so that the backlight luminance provided by the OLED panel 02 can be adjusted.

To sum up, the display device is composed of the liquid crystal display panel 01 and the OLED panel 02 which is an OLED backlight, and different sub-pixels in the OLED panel 02 can provide the backlight of different colors that can constitute the three primary colors. Thus, the display device does not require a color filter substrate disposed therein. In addition, a final display effect of the display device at the pixel cell 100 is overlapped by luminance grayscales provided by the liquid crystal display panel 01 and the backlight of three primary colors provided by the OLED panel 02.

Prior to that the shift register unit SR provides the data signal Vdata inputted from the source signal terminal Source to the pixel cell 100 on the liquid crystal display panel 01 and to the sub-pixel 200 corresponding to the pixel cell 100 and located on the OLED panel 02 which is an OLED backlight, the pixel cell 100 and the sub-pixel 200 need to be in a turned-on state.

In order to turn on the pixel cell 100 and the sub-pixel 200, as shown in FIG. 2, the pixel cell 100 on the liquid crystal display panel 01 may be connected to a gate driver 20 via a first gate line S1, and the sub-pixel 200 on the OLED panel 02 which is an OLED backlight may be connected to the gate driver 20 via a second gate line S2. In this way, the gate driver 20 can output a gate scan signal to the first gate line S1 to thereby control the pixel cell 100 to be turned on via the first gate line S1, and output a gate scan signal to the second gate line S2 to thereby control the sub-pixel 200 to be turned on via the second gate line S2.

Alternatively, the first gate line S1 and second gate line S2 may be connected, so that there is no need for the gate driver 20 to output a gate scan signal separately to the first gate line S1 and the second gate line S2, and further, the pixel cell 100 and the sub-pixel 200 corresponding to the pixel cell 100 may be turned on simultaneously, thereby a response speed of the display device can be increased.

Alternatively, the shift register unit SR is capable of storing temporarily the data signal Vdata outputted by the source signal terminal Source, and the pulse signal terminal PS can control at what time the shift register unit SR outputs via the signal output terminal OUTPUT the data signal Vdata to the pixel cell 100 and the sub-pixel 200 whose positions correspond to each other. For example, a pulse signal outputted from the pulse signal terminal PS may be provided by a pulse signal generator 30 shown in FIG. 2, or provided by the source driver 10, the present disclosure makes no limitations thereto. The following embodiments are described all with the pulse signal outputted from the pulse signal terminal PS being provided by the pulse signal generator 30 as an example. For example, the pulse signal generator 30 may be connected to the pulse signal terminal PS, so as to input a pulse signal to the pulse signal terminal PS.

The present disclosure makes no limitations to a position of the shift register unit SR, the shift register unit SR may be fabricated on the liquid crystal display panel 01, or on the OLED panel 02 which is an OLED backlight. Optionally, one shift register unit SR may be disposed within each pixel 100, so that all shift register units SR are evenly distributed on the display panel (the liquid crystal display panel 01 or the OLED panel 02), this can avoid a display effect from being affected by that the shift register units SR have an uneven influence on an effective display region of the pixel cell 100 due to uneven distribution of the shift register units SR on the display panel.

An embodiment of the present disclosure provides a display driving circuit for driving pixel cells located on a liquid crystal display panel and sub-pixels located on an OLED panel which is an OLED backlight, one the pixel cell corresponds to at least one sub-pixel. Further, the display driving circuit comprises a shift register unit. The shift register unit has a source signal terminal, a pulse signal terminal, and at least one signal output terminal, and configured to output a signal inputted from the source signal terminal to the signal output terminal under control of the pulse signal terminal. One pixel cell and at least one sub-pixel corresponding to the one pixel cell are connected to the same signal output terminal.

Since one pixel cell and at least one sub-pixel corresponding to the one pixel cell are connected to the same signal output terminal, when the shift register unit outputs a data signal inputted from the source signal terminal to the signal output terminal under control of the pulse signal terminal, the pixel cell and the sub-pixel that are connected to the signal output terminal can simultaneously receive the data signal to complete pixel charging and perform displaying. In this way, by means of the display driving circuit, pixel cells located on the liquid crystal display panel and sub-pixels located on the OLED panel can be simultaneously driven to display, without disposing driving circuits separately for the liquid crystal display panel and the OLED panel which is an OLED backlight, which can simplify product structure and reduce costs.

The present disclosure makes no limitations to the number of the sub-pixels 200 to which one pixel cell 100 can correspond. In this case, on the one hand, one pixel cell 100 and one sub-pixel 200 corresponding to the pixel cell 100 are connected to the same signal output terminal OUTPUT, so that the larger the number of the sub-pixel 200 to which the pixel cell 100 can correspond is, the larger the number of the output terminals OUTPUT that need to be set is, which results in a complex circuit structure. On the other hand, if one pixel cell 100 corresponds to one sub-pixel 200, then the pixel cell 100 can only emit monochromatic light, so that three adjacent different pixel cells 100 together are able to achieve the three primary colors (e.g., R, G, B) for displaying. This will cause a resolution of the display device composed of the liquid crystal display panel 01 and the OLED panel 02 which is an OLED backlight to decrease, and exquisiteness of a displayed image to reduce. Three different sub-pixels 200 can emit light of a different color respectively to constitute the three primary colors.

To sum up, optionally, one pixel cell 100 corresponds to three sub-pixels 200 capable of emitting light of different colors. In this way, each pixel cell 100 is able to achieve displaying of the three primary colors, which can ensure that the composed display device has a high resolution, and a display effect of the display device is improved.

Figure 3:
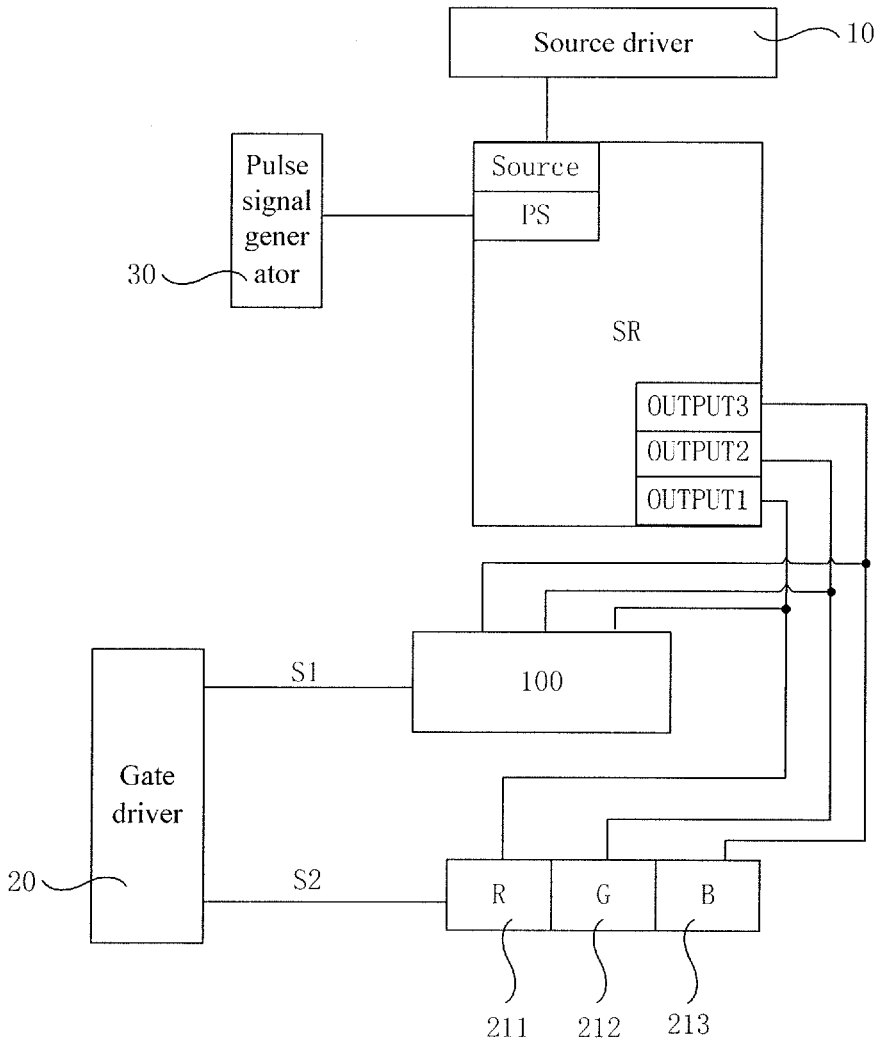
FIG. 3 is another schematic diagram of structure of a display driving circuit provided by an embodiment of the present disclosure.

FIG. 3 shows a schematic diagram of structure of another display driving circuit provided by an embodiment of the present disclosure. As shown in FIG. 3, the at least one sub-pixel 200 corresponding to one pixel cell 100 includes a first sub-pixel 211, a second sub-pixel 212, and a third sub-pixel 213. In FIG. 3, the at least one signal output terminal OUTPUT includes a first signal output terminal OUTPUT1, a second signal output terminal OUTPUT2, and a third signal output terminal OUTPUT3.

In this case, the first signal output terminal OUTPUT1 is connected to the pixel cell 100 and the first sub-pixel 211.

The second signal output terminal OUTPUT2 is connected to the pixel cell 100 and the second sub-pixel 212.

The third signal output terminal OUTPUT3 is connected to the pixel cell 100 and the third sub-pixel 213.

For example, light rays transmit respectively through the first sub-pixel 211, the second sub-pixel 212, and the third sub-pixel 213 constitute light of the three primary colors.

It should be noted that the present disclosure makes no limitations to light ray that constitute the three primary colors. They may be red light, green light, and blue light, or cyan light, magenta light, and yellow light. For convenience of description, hereinafter, descriptions are provided with the first sub-pixel 211 emits red light, the second sub-pixel 212 emits green light, and the third sub-pixel 213 emits blue light as an example.

In this way, the data signal Vdata inputted from the source signal terminal Source can pass through the shift register unit SR, and be outputted, to the pixel cell 100 and the first sub-pixel 211 via the first signal output terminal OUTPUT1, to the pixel cell 100 and the second sub-pixel 212 via the second signal output terminal OUTPUT2, and to the pixel cell 100 and the third sub-pixel 213 via the third signal output terminal OUTPUT3, respectively, at different times under the control of the pulse signal data terminal PS. Herein, a valid time length of the data signal Vdata inputted from the source signal terminal Source (a high voltage level maintenance time length of the data signal Vdata as shown in FIG. 4) is required to be capable of ensuring that the pixel electrodes (Pixel) in the pixel cell 100 can be fully charged, to thereby ensure that liquid crystal molecules corresponding to the pixel cell 100 can be deflected to a desired angle, so that the pixel cell 100 can be adjusted to a required grayscale values.

It should be noted that, the at least one signal output terminal OUTPUT including the first signal output terminal OUTPUT1, the second signal output terminal OUTPUT2, and the third signal output terminal OUTPUT3 refers to that the shift register unit SR may be composed of a single shift register having three signal output terminals, i.e., the first signal output terminal OUTPUT1, the second signal output terminal OUTPUT2, and the third signal output terminal OUTPUT3. Alternatively, the shift register unit SR may be composed of three shift registers each having one signal output terminal. For example, when the shift register unit SR is composed of a first shift register, a second shift register, and a third shift register, the first shift register has the first signal output terminal OUTPUT1, the second shift register has the second signal output terminal OUTPUT2, and the third shift register has the third signal output terminal OUTPUT3. The present disclosure makes no limitations to a concrete structure of the shift register unit SR, as long as the shift register unit SR can output the signal from the signal source terminal Source to the signal output terminal under the control of the pulse signal terminal PS.

Next, in conjunction with FIG. 4, driving process in one image frame of the display driving circuit shown in FIG. 3 will be described in detail.

Figure 4:
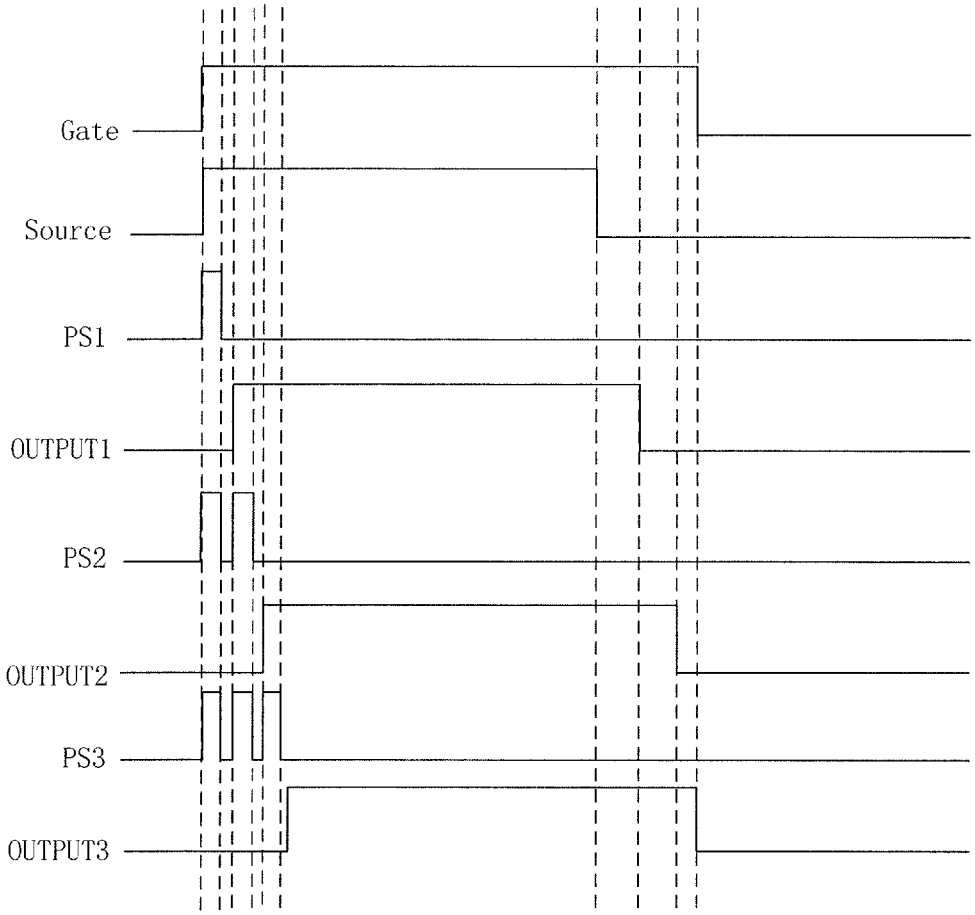
FIG. 4 is a timing diagram of respective control signals for controlling the display driving circuit as shown in FIG. 3 provided by an embodiment of the present disclosure.

FIG. 4 shows a timing diagram of respective control signals for driving the display driving circuit as shown in FIG. 3 provided in an embodiment of the present disclosure. First, the gate driver 20 inputs a gate scan signal Gate to the first gate line S1, to turn on the pixel cell 100. Besides, since the first sub-pixel 211, the second sub-pixel 212, and the third sub-pixel 213 are located in the same row, each of them is connected to the second gate line S2. Therefore, when the gate driver 20 inputs the gate scan signal Gate to the second gate line S2, all of the first sub-pixel 211, the second sub-pixel 212, and the third sub-pixel 213 can be turned on.

Next, the pulse signal terminal PS of the shift register unit SR is input a first pulse signal PS1, so that the shift register unit SR outputs the data signal Vdata inputted from source signal terminal Source to the first signal output terminal OUTPUT1, and charges the pixel cell 100 and the first sub-pixel 211 through the first signal output terminal OUTPUT1.

In this case, the first sub-pixel 211 can emit red light (R) whose luminance matches the data signal Vdata. Further, the data signal Vdata charges the pixel cell 100 to cause grayscale values of the pixel cell 100 to match the data signal Vdata.

Next, the pulse signal terminal PS of the shift register unit SR is input a second pulse signal PS2, so that the shift register unit SR outputs the data signal Vdata inputted from source signal terminal Source to the second signal output terminal OUTPUT2, and charges the pixel cell 100 and the second sub-pixel 212 via the second signal output terminal OUTPUT2.

In this case, the second sub-pixel 212 can emit green light (G) whose luminance matches the data signal Vdata. Further, the data signal Vdata charges the pixel cell 100 to cause the grayscale values of the pixel cell 100 to match the data signal Vdata.

Next, the pulse signal terminal PS of the shift register unit SR is input a third pulse signal PS3, so that the shift register unit SR outputs the data signal Vdata inputted from source signal terminal Source to the third signal output terminal OUTPUT3, and charges the pixel cell 100 and the third sub-pixel 213 via the third signal output terminal OUTPUT3.

In this case, the third sub-pixel 213 can emit blue light (B) whose luminance matches the data signal Vdata. Further, the data signal Vdata charges the pixel cell 100 to cause the grayscale values of the pixel cell 100 to match the data signal Vdata.

As a result, in an image frame, i.e., within a time period during which the gate drive signal Gate in FIG. 4 is a high level, under the control of the display driving circuit described above, the first sub-pixel 211, the second sub-pixel 212, and the third sub-pixel 213 corresponding to the pixel cell 100 emit monochromatic light of a different color, respectively. And after the pixel cell 100 is charged by the data signal Vdata, liquid crystal molecules contained therein are deflected to corresponding angles, thereby desired grayscale values are obtained, so that the composed display device can perform picture displaying.

Another aspect of the embodiments of the present disclosure provides a display device comprising the liquid crystal display panel 01 and the OLED panel 02 which is an OLED backlight that are disposed opposite to each other as shown in FIG. 1. In addition, the display device further comprises any of the display driving circuit described above. Structure and advantageous effect of the display driving circuit comprised by the display device are the same as those of the display driving circuit provided in the foregoing embodiments. Since the structure of the display driving circuit has already been described in the foregoing embodiments in detail, no more details repeated here.

It should be noted that, in the embodiments of the present disclosure, the display device may be a liquid crystal TV, a digital photo frame, a mobile phone, a tablet computer, or any products or components having a display function.

Figure 5:
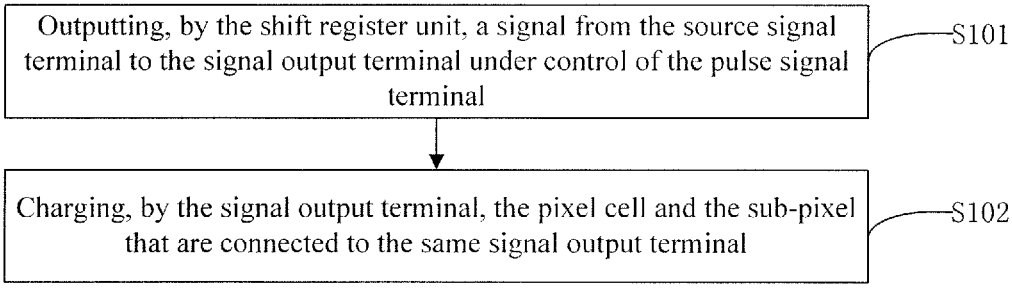
FIG. 5 is a flowchart of a method for controlling the display driving circuit provided by an embodiment of the present disclosure.

FIG. 5 shows a flowchart of a method for controlling the display driving circuit provided by an embodiment of the present disclosure. As shown in FIG. 5, an embodiment of the present disclosure provides a method of controlling any of the display driving circuits described above, the method comprises the following working procedures:

In step S101, the shift register unit SR as shown in FIG. 2 outputs a signal from the source signal terminal Source to the signal output terminal OUTPUT under the control of the pulse signal terminal PS.

In step S102, the pixel cell 100 and the sub-pixel 200 that are connected to the same signal output terminal OUTPUT are charged through the signal output terminal OUTPUT.

Since one pixel cell and at least one sub-pixel corresponding to the one pixel cell are connected to the same signal output terminal, thus when the shift register unit outputs a data signal inputted from the source signal terminal to the signal output terminal under the control of the pulse signal terminal, the pixel cell and the sub-pixel that are connected to the signal output terminal can simultaneously receive the data signal to complete pixel charging and perform displaying. In this way, by means of the display driving circuit, pixel cells located on the liquid crystal display panel and sub-pixels located on the OLED panel which is an OLED backlight can be simultaneously driven to display, without disposing driving circuits separately for the liquid crystal display panel and the OLED panel, which can simplify product structure and reduce costs.

On basis of this, prior to that the shift register unit SR provides the data signal Vdata inputted from the source signal terminal Source to the pixel cell 100 on the liquid crystal display panel 01 and to the sub-pixel 200 corresponding to the pixel cell 100 and located on the OLED panel 02 which is an OLED backlight, the pixel cell 100 and the sub-pixel 200 need to be in a turned-on state. Besides, since the source signal terminal Source needs to provide a required data signal Vdata to the liquid crystal display panel 01 and the OLED panel 02, therefore, prior to the step S101, the method may further comprise:

First, the gate driver 20 shown in FIG. 2 controls the pixel cell 100 to be turned on via the first gate line S1.

For example, the gate driver 20 inputs the gate drive signal Gate to the first gate line S1, and then turns on the pixel cell 100 via the gate driver signal Gate.

Next, the gate driver 20 controls the sub-pixel 200 corresponding to the pixel cell 100 to be turned on via the second gate line S2.

For example, the gate driver 20 inputs the gate drive signal Gate to the second gate line S2, then turns on the sub-pixel 200 corresponding to the pixel 100 via the gate driver signal Gate.

Thereafter, the source driver 10 shown in FIG. 2 outputs the data signal Vdata to the source signal terminal Source.

The data signal Vdata can enable the pixel cell 100 and the sub-pixel 200 corresponding to the pixel cell 100 to be charged. As a result, a final display effect of the display device composed of the liquid crystal display panel 01 and the OLED panel 02 which is an OLED backlight at the pixel cell 100 is overlapped by the luminance grayscales provided by the liquid crystal display panel and the backlight of three primary colors provided by the OLED panel 02.

In addition, the shift register unit SR is capable of storing temporarily the data signal Vdata input from the source signal terminal Source, and the pulse signal terminal PS can control at what time the shift register unit SR outputs via the signal output terminal OUTPUT the data signal Vdata to the pixel cell 100 and the sub-pixel 200 whose positions correspond to each other. Thus, in a case where the display driving circuit described above comprises the pulse signal generator 30, prior to the step S101, the method further comprises that the pulse signal generator 30 inputs a pulse signal to the pulse signal terminal PS.

In order to improve a resolution of the display device composed of the liquid crystal display panel 01 and the OLED panel 02 which is an OLED backlight on the basis of avoiding a complex circuit structure, optionally, one pixel cell 100 may correspond to three sub-pixels 200 capable of emitting light of different colors. That is to say, the at least one sub-pixel 200 corresponding to one pixel cell 100 includes a first sub-pixel 211, a second sub-pixel 212, and a third sub-pixel 213, wherein the at least one signal output terminal OUTPUT includes a first signal output terminal OUTPUT1, a second signal output terminal OUTPUT2, and a third signal output terminal OUTPUT3.

Figure 6:
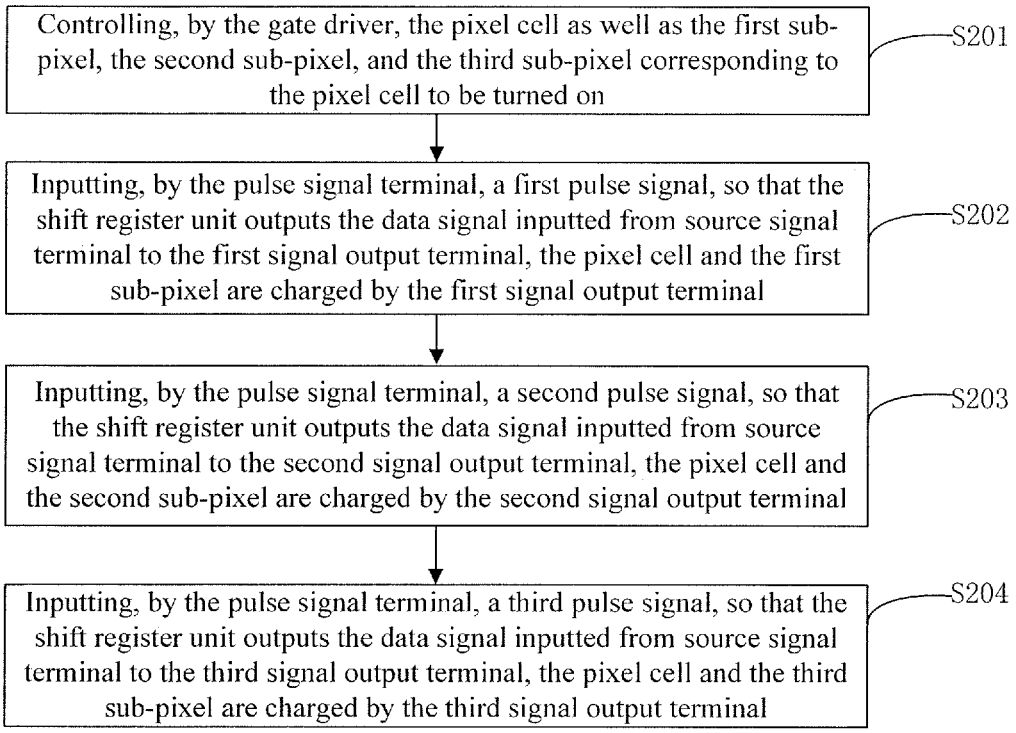
FIG. 6 is another flowchart of a method for controlling the display driving circuit provided by an embodiment of the present disclosure.

FIG. 6 shows a flowchart of another method for controlling the display driving circuit provided by an embodiment of the present disclosure. As shown in FIG. 6, the driving method comprises the following operation procedures:

In step S201, the gate driver 20 controls the pixel cell 100 as well as the first sub-pixel 211, the second sub-pixel 212, and the third sub-pixel 213 corresponding to the pixel cell 100 to be turned on.

For example, the gate driver 20 inputs a gate scan signal Gate to the first gate line S1, to turn on the pixel cell 100. Besides, since the first sub-pixel 211, the second sub-pixel 212, and the third sub-pixel 213 are located in the same row, thus each of them is connected to the second gate line S2. Therefore, when the gate driver 20 inputs the gate scan signal Gate to the second gate line S2, all of the first sub-pixel 211, the second sub-pixel 212, and the third sub-pixel 213 can be turned on.

In step S202, the pulse signal terminal PS is input a first pulse signal PS1, so that the shift register unit SR outputs the data signal Vdata inputted from source signal terminal Source to the first signal output terminal OUTPUT1, and charges the pixel cell 100 and the first sub-pixel 211 via the first signal output terminal OUTPUT1.

In this way, the first sub-pixel 211 can emit red light (R) whose luminance matches the data signal Vdata. Further, the data signal Vdata charges the pixel cell 100 to cause the grayscale values of the pixel cell 100 to match the data signal Vdata.

In step S203, the pulse signal terminal PS is input a second pulse signal PS2, so that the shift register unit SR outputs the data signal Vdata inputted from source signal terminal Source to the second signal output terminal OUTPUT2, and charges the pixel cell 100 and the second sub-pixel 212 via the second signal output terminal OUTPUT2.

In this way, the second sub-pixel 212 can emit green light (G) whose luminance matches the data signal Vdata. Further, the data signal Vdata charges the pixel cell 100 to cause the grayscale values of the pixel cell 100 to match the data signal Vdata.

In step 204, the pulse signal terminal PS of the shift register unit SR is input a third pulse signal PS3, so that the shift register unit SR outputs the data signal Vdata inputted from source signal terminal Source to the third signal output terminal OUTPUT3, and charges the pixel cell 100 and the third sub-pixel 213 via the third signal output terminal OUTPUT3.

In this way, the third sub-pixel 213 can emit blue light (B) whose luminance matches the data signal Vdata. Further, the data signal Vdata charges the pixel cell 100 to cause the grayscale values of the pixel cell 100 to match the data signal Vdata.

To sum up, in an image frame, i.e., within a time period during which the gate drive signal Gate in FIG. 4 is a high level, under the control of the display driving circuit described above, the first sub-pixel 211, the second sub-pixel 212, and the third sub-pixel 213 corresponding to the pixel cell 100 emit monochromatic light of a different color, respectively. And after the pixel cell 100 is charged by the data signal Vdata, liquid crystal molecules contained therein are deflected to corresponding angles, thereby desired grayscale values are obtained, so that the composed display device can display pictures.

The above described merely are specific implementations of the present disclosure, but the protection scope of the present disclosure is not limited thereto, modification and replacements easily conceivable for those skilled in the art within the technical range revealed by the present disclosure all fall into the protection scope of the present disclosure. Therefore, the protection scope of the present disclosure is based on the protection scope of the claims.

The present application claims priority of the Chinese Patent Application No. 201610004880.9 filed on Jan. 4, 2016, the entire disclosure of which is hereby incorporated in full text by reference as part of the present application.

What is claimed is:

1. A display driving circuit for driving pixel cells located on a liquid crystal display panel and sub-pixels located on an OLED panel which is an OLED backlight, one of the pixel cells corresponding to at least one of the sub-pixels, the display driving circuit comprising:

a shift register unit having a source signal terminal, a pulse signal terminal, and at least one signal output terminal, and configured to output a signal inputted from the source signal terminal to the signal output terminal under control of the pulse signal terminal;

wherein said one of the pixel cells and said at least one of the sub-pixels corresponding thereto are connected to the same signal output terminal, so that said pixel cells and sub-pixels are simultaneously charged and driven by a signal output to the signal output terminal.

2. The display driving circuit as claimed in claim 1, wherein the at least one sub-pixel corresponding to one of the pixel cells includes a first sub-pixel, a second sub-pixel, and a third sub-pixel, the at least one signal output terminal includes a first signal output terminal, a second signal output terminal, and a third signal output terminal;

the first signal output terminal is connected to the pixel cell and the first sub-pixel;

the second signal output terminal is connected to the pixel cell and the second sub-pixel;

the third signal output terminal is connected to the pixel cell and the third sub-pixel; and light rays that transmit through the first sub-pixel, the second sub-pixel, and the third sub-pixel respectively constitute light rays of three primary colors.

3. The display driving circuit as claimed in claim 1, wherein it further comprises a gate driver and a source driver;

the gate driver is connected to the pixel cell via a first gate line, and configured to control tuning-on of the pixel cell via the first gate line;

the gate driver is connected to the sub-pixel via a second gate line, and configured to control tuning-on of the sub-pixel via the second control gate line; and the source driver is connected to the source signal terminal, and configured to output a data signal to the source signal terminal.

4. The display driving circuit as claimed in claim 1, wherein it further comprises a pulse signal generator connected to the pulse signal terminal and configured to input a pulse signal to the pulse signal terminal.

5. The display driving circuit as claimed in claim 3, wherein the first gate line and the second gate line are connected to each other directly, without being connected to said gate driver.

6. A display device, comprising a liquid crystal display panel and an OLED panel which is an OLED backlight disposed opposite to each other, and further comprising the display driving circuit according to claim 1.

7. The display device as claimed in claim 6, wherein the at least one sub-pixel corresponding to one of the pixel cells includes a first sub-pixel, a second sub-pixel and a third sub-pixel, the at least one signal output terminal includes a first signal output terminal, a second signal output terminal, and a third signal output terminal;

the first signal output terminal is connected to the pixel cell and the first sub-pixel;

the second signal output terminal is connected to the pixel cell and the second sub-pixel;

the third signal output terminal is connected to the pixel cell and the third sub-pixel; and light rays that transmit through the first sub-pixel, the second sub-pixel, and the third sub-pixel respectively constitute light rays of three primary colors.

8. The display device as claimed in claim 6, wherein it further comprises a gate driver and a source driver;

the gate driver is connected to the pixel cell via a first gate line, and configured to control tuning-on of the pixel cell via the first gate line;

the gate driver is connected to the sub-pixel via a second gate line, and configured to control tuning-on of the sub-pixel via the second control gate line; and the source driver is connected to the source signal terminal, and configured to output a data signal to the source signal terminal.

9. The display device as claimed in claim 6, wherein it further comprises a pulse signal generator connected to the pulse signal terminal and configured to input a pulse signal to the pulse signal terminal.

10. The display device as claimed in claim 8, wherein the first gate line and the second gate line are connected to each other directly, without being connected to said gate driver.

11. A method for controlling a display driving circuit, the display driving circuit is configured to drive pixel cells located on a liquid crystal display panel and sub-pixels located on an OLED panel which is an OLED backlight, one of the pixel cells corresponding to at least one of the sub-pixels, the display driving circuit comprising:

a shift register unit having a source signal terminal, a pulse signal terminal, and at least one signal output terminal, and configured to output a signal inputted from the source signal terminal to the signal output terminal under control of the pulse signal terminal;

wherein said one of the pixel cells and said at least one of the sub-pixels corresponding thereto are connected to the same signal output terminal, the method comprising:

outputting, by the shift register unit, a signal input from the source signal terminal to the signal output terminal under control of the pulse signal terminal; and simultaneously charging and driving, by the signal output to the signal output terminal, pixel cells and sub-pixels that are connected to the same signal output terminal.

12. The method for controlling the display driving circuit as claimed in claim 11, wherein in a case where the at least one sub-pixel corresponding to one of the pixel cells includes a first sub-pixel, a second sub-pixel, and a third sub-pixel, the at least one signal output terminal includes a first signal output terminal, a second signal output terminal, and a third signal output terminal, the method comprises:

inputting a first pulse signal from the pulse signal terminal, outputting a signal from the source signal terminal to the first signal output terminal and charging the pixel cell and the first sub-pixel via the first signal output terminal by the shift register unit;

inputting a second pulse signal from the pulse signal terminal, outputting a signal from the source signal terminal to the second signal output terminal and charging the pixel cell and the second sub-pixel via the second signal output terminal by the shift register unit; and inputting a third pulse signal from the pulse signal terminal, outputting a signal from the source signal terminal to the third signal output terminal and charging the pixel cell and the third sub-pixel via the third signal output terminal by the shift register unit.

13. The method for controlling the display driving circuit as claimed in claim 11, wherein prior to outputting, by the shift register unit, a signal from the source signal terminal to the signal output terminal under the control of the pulse signal terminal, the method comprises:

controlling, by the gate driver, tuning-on of the pixel cell via the first gate line;

controlling, by the gate driver, tuning-on of the sub-pixel corresponding to the pixel cell via the second gate line; and outputting, by the source driver, a data signal to the source signal terminal.

14. The method for controlling the display driving circuit as claimed in claim 11, wherein prior to outputting, by the shift register unit, a signal from the source signal terminal to the signal output terminal under the control of the pulse signal terminal, the method comprises:

inputting, by a pulse signal generator, a pulse signal to the pulse signal terminal.

15. The method for controlling the display driving circuit as claimed in claim 11, wherein in the display driving circuit, the at least one sub-pixel corresponding to one of the pixel cells includes a first sub-pixel, a second sub-pixel, and a third sub-pixel, the at least one signal output terminal includes a first signal output terminal, a second signal output terminal, and a third signal output terminal;

the first signal output terminal is connected to the pixel cell and the first sub-pixel;

the second signal output terminal is connected to the pixel cell and the second sub-pixel;

the third signal output terminal is connected to the pixel cell and the third sub-pixel; and light rays that transmit through the first sub-pixel, the second sub-pixel, and the third sub-pixel respectively constitute light rays of three primary colors.

16. The method for controlling the display driving circuit as claimed in claim 11, wherein the display driving circuit further comprises a gate driver and a source driver;

the gate driver is connected to the pixel cell via a first gate line, and configured to control tuning-on of the pixel cell via the first gate line;

the gate driver is connected to the sub-pixel via a second gate line, and configured to control tuning-on of the sub-pixel via the second control gate line; and the source driver is connected to the source signal terminal, and configured to output a data signal to the source signal terminal.

17. The method for controlling the display driving circuit as claimed in claim 11, wherein the display driving circuit further comprises a pulse signal generator connected to the pulse signal terminal and configured to input a pulse signal to the pulse signal terminal.

18. The method for controlling the display driving circuit as claimed in claim 16, wherein in the display driving circuit, the first gate line and the second gate line are connected directly, without being connected to said gate driver.

* * * * *